United States Patent [19]

O'Connell

[11] 4,313,506

[45] Feb. 2, 1982

[54] DRILL CUTTER BIT

[76] Inventor: Thomas L. O'Connell, 9590 Jackson St., Mentor, Ohio 44060

[21] Appl. No.: 186,204

[22] Filed: Sep. 10, 1980

[51] Int. Cl.[3] ..... E21B 10/58

[52] U.S. Cl. ..... 175/410; 175/418

[58] Field of Search ..... 175/410, 417, 418; 299/94; 76/108 A

[56] References Cited

U.S. PATENT DOCUMENTS

| | | | |
|---|---|---|---|
| 1,641,321 | 9/1927 | Cubley | 175/418 |
| 2,844,358 | 7/1958 | Eberman et al. | 175/418 |
| 3,434,553 | 3/1969 | Weller | 175/418 |
| 3,434,554 | 3/1969 | Bower, Jr. | 175/418 |
| 4,099,585 | 7/1978 | Emmerich | 175/418 |
| 4,190,128 | 2/1980 | Emmerich | 175/418 |

FOREIGN PATENT DOCUMENTS

| | | | |
|---|---|---|---|
| 868781 | 4/1971 | Canada | 175/418 |

*Primary Examiner*—James A. Leppink

*Attorney, Agent, or Firm*—Watts, Hoffmann, Fisher & Heinke Co.

[57] ABSTRACT

A drill cutter bit having good performance characteristics for drilling in various types of strata including not only hard and medium rock formations but also soft rock formations such as in mine roof drilling. The drill bit includes an elongated hollow shank portion and an integral head portion having multiple working surfaces provided with a transversely extending slot adapted to receive a plate-like, insert cutter element therein. The work surfaces include pairs of oppositely disposed heel and compression surfaces that taper downwardly and outwardly via a predetermined compression angle to provide an abrading and shearing action for progressively reducing the drill cuttings to a relatively dust-like consistency. A pair of oppositely disposed dust collecting openings are constructed and arranged to cooperate with the compression surfaces to define dust collection intake passageways that act to give a metering action on the dust-like material for removal through the shank portion during drilling.

23 Claims, 8 Drawing Figures

DRILL CUTTER BIT

BACKGROUND OF THE INVENTION

The present invention relates to a cutter bit for drills, and more particularly relates to a new and improved construction for a cutter bit for drills of the type used in roof drilling in coal mines or the like. Heretofore, conventional drills, such as those employed for drilling holes in the roofs of mine shafts for installing roof bolts or receiving explosive charges, generally comprise elongated, hollow drill rods adapted to be connected to a source of rotary power. Generally, the upper free end of the drill rod has mounted a cast or forged cutter bit including a head portion to which is permanently attached a plate-like insert element, such as of carbide or the like. Because of the fact that drilling in rock formations produces large quantities of drill cuttings and dust, it has been the practice to remove these materials by means of holes or openings provided in the walls of the hollow drill rod beneath the cutter drill bit, and drawing this material into the drill rod using a suitable vacuum pump to draw in the dust-laden air, or alternatively, by forcing a coolant liquid up through the drill rod and out through the holes to thereby wash away the chips and dust. More recently, because of the number of problems with such type of arrangements, it has now been known to make the cutter bit of a hollow interior construction with dust collecting holes or openings being formed in the cutter bit beneath the carbide insert so that the carbide insert is more nearly adjacent to the area in which the dust is formed for greater efficiency in dust collection. One such prior drill bit is commercially available under applicant's trademark "DUST HOG". This bit has good performance characteristics in that it runs cooler, penetrates faster and lasts longer than conventional bits in dry drilling applications, such as disclosed for example in U.S. Pat. No. 3,613,807 and No. 3,187,825. For further examples of drill bits having the features of dust collecting holes or openings reference may be had to U.S. Pat. Nos. 3,434,553 and 3,434,554.

Though such conventional "DUST HOG" drill bits have overcome many, if not all, of many problems attendant in prior bits for use in dry drilling applications, it has been recently discovered that the conventional "DUST HOG" bits are not as efficient for drilling in soft rock formations. For example, it has been found that in drilling in soft rock at a fast rate of penetration, this type of cutter bit creates more cuttings than can be carried and removed through the interior of the drill rod. These cuttings then clog and pack the drill rod causing dust puffing or stoppage. For example, in drilling through shale, the shale cuttings usually break-up into different sized chunks. These chunks then tend to block the holes or openings provided in such prior cutter bits.

Accordingly, the present invention has provided a new and improved cutter bit which overcomes the problems attendant in prior conventional bits utilized in dry drilling operations. More specifically, the cutter bit of the present invention greatly enhances the flexibility and performance characteristics for a wide variety of drilling applications, and which is particularly suited for drilling in soft rock formations typically found in drilling roof top strata. In such strata it has been discovered that the cutter bit of the present invention not only minimizes drill rod clogging but also the bit cuts at a faster rate which also increases the length of the bit life by generally the same ratio. In addition, it has also been found that the drill string employed with the cutter bit of the present invention does not stick in the drilled hole indicating that a straighter hole has been drilled as compared to conventional solid head drill bits. In addition to good performance characteristics in hard, medium as well as soft top rock formations, the cutter bit of the invention has been found to provide good drilling characteristics in irregular top rock formations where extensive breakage has been experienced with previous type drill bits.

Moreover, the present invention provides a new and improved cutter bit which has good performance characteristics in hard, medium and irregular rock formations, and improved performance characteristics in soft rock formations providing a cutter bit which is believed, for the first time, to have in fact, relatively universal application. Other more specific advantages of the present cutter bit include its ability to provide a stronger and more stable support for the carbide cutter blade or element. Also, the cutter bit by its construction and design has a hefty configuration so as to minimize, if not prevent, breakage. Further, the cutter bit of the present invention can be easily fabricated and at reduced cost by reason of the elimination of hard to machine dust collection parts and by having less heel to grind off during fabrication. In essence, the cutter bit of the invention incorporates all of the advantages of applicants "DUST HOG" (i.e. runs cooler, penetrates faster and lasts longer than conventional bits) through the use of especially designed dust collection holes that are disposed in close proximity to the carbide cutting (edge) element.

SUMMARY OF THE INVENTION

In accordance with the present invention, the cutter bit comprises an elongated, hollow shank portion having a bore extending from an open end thereof and with a head portion extending from and made integral with the shank portion. The head portion has multiple tapered heel and compression surfaces that extend downwardly and outwardly in a direction away from the longitudinal central axis of the bit. The compression surfaces taper downwardly and outwardly at a greater angle (i.e. compression angle) relative to other of the heel surfaces to provide an abrading and shearing action to progressively reduce the drill cuttings to a relatively fine dust-like consistency for controlled discharge through a pair of oppositely disposed dust collection openings provided therebelow and in the shank portion. The dust collection openings are constructed so as to define with the compression surfaces dust collection intake passageways that act to meter the reduced dust material for discharge through the dust collection openings for final removal via the drill rod under vacuum without clogging thereof. The head portion includes a transversely extending slot adapted to receive a plate-like, insert carbide cutter element disposed at an acute angle in respect to the general planes containing the dust collection openings for producing the drill cuttings upon rotation of the drill bit.

Further objects and advantages of the invention will be more clearly apparent and understood from the following description taken in conjunction with the accompanying drawings.

DESCRIPTION OF THE PREFERRED EMBODIMENTS

Figure 1:
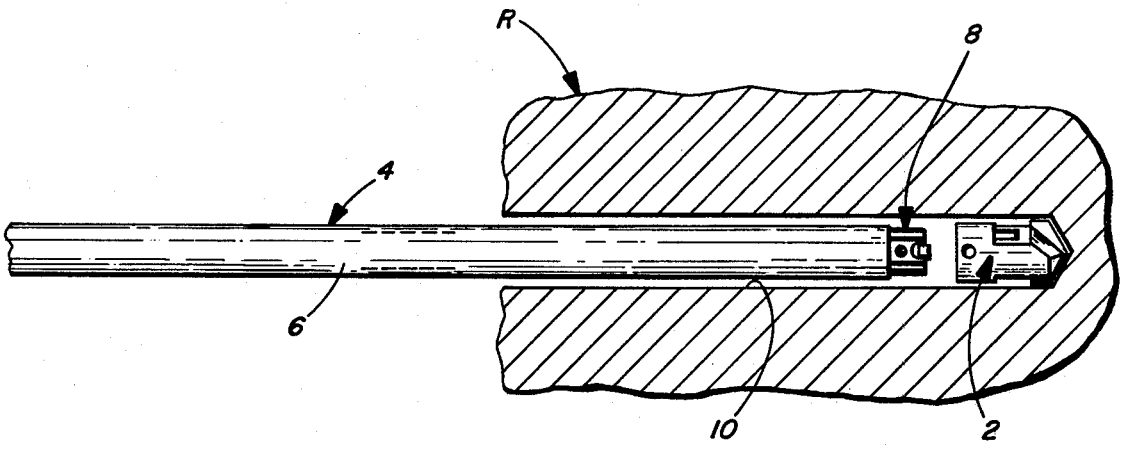
FIG. 1 is a generally exploded view, partly in section, illustrating the cutter bit of the present invention adapted for use with a drill rod system in a typical roof mine drilling operation.
Figure 2:
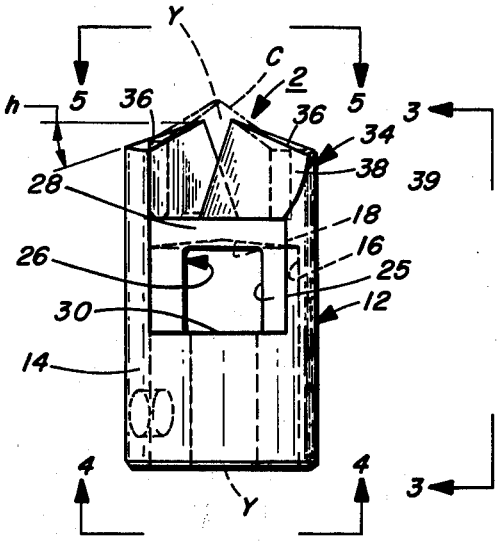
FIG. 2 is a side elevation view of the cutter bit of the invention with the insert cutter element illustrated in phantom lines for purposes of clarity.
Figure 3:
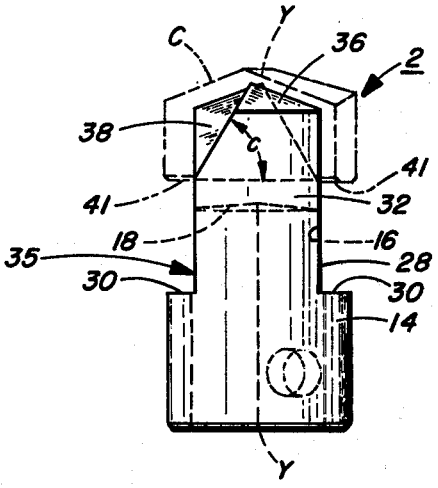
FIG. 3 is a side elevation view of the cutter bit of FIG. 2 but rotated approximately 90 degrees in a counter-clockwise direction.
Figure 4:
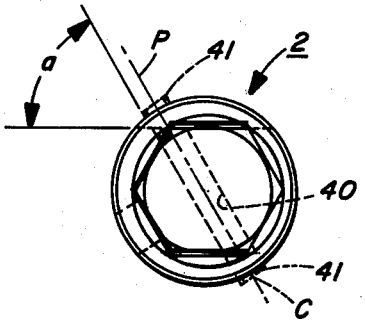
FIG. 4 is a bottom view looking in the direction of the line 4—4 of FIG. 2.
Figure 8:
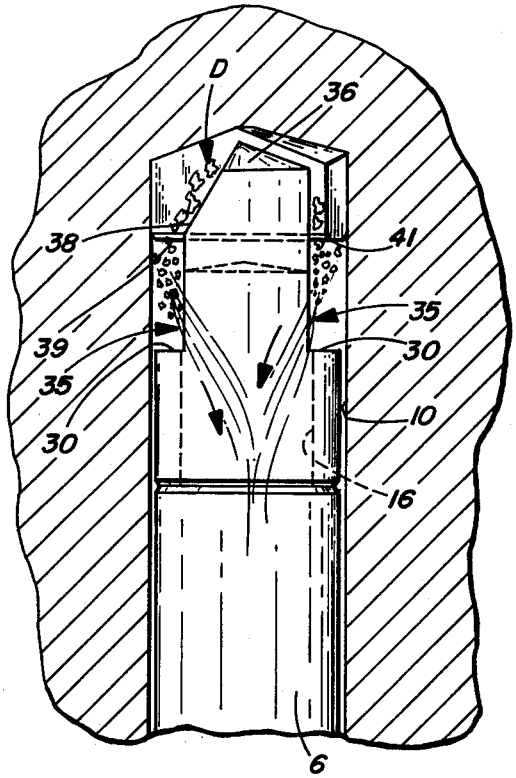
FIG. 8 is a fragmentary elevation view illustrating a typical drilling operation in accordance with the invention.

Referring again to the drawings and in particular to FIGS. 1 and 8 thereof, there is illustrated the cutter bit of the invention, designated generally at 2, adapted for use with a drill rod system, designated generally at 4, for performing drilling operations in various types of strata R including irregular, hard, medium and soft rock formations, for example. As known in the art, the drill bit 2 may be detachably connected to the drill rod 6 by means of a snap-connection end 8 for carrying out what is generally referred to as through-the-steel drilling operations. It will be understood, however, that the cutter bit may be formed or attached directly to the drill rod 6 or to any other type of rotary powered drill shaft for drilling holes 10, as may be desired.

Referring now more particularly to FIGS. 2–7, the drill bit 2 of the invention comprises a unitary, one-piece body member which may be formed, such as by casting or forging, of a preferably generally cylindrical configuration, however, other irregular or polygonal shapes may be employed. As shown, the body 12 includes an elongated, hollow cylindrical shank portion 14 having an interior axial bore 16 extending upwardly from one open end thereof. The bore bottoms or terminates in an upper roof or top surface 18 which may be of a generally flat or conical configuration in elevation. The bore 16 preferably has a generally hexagonal configuration, in transverse section, to define a female socket adapted to receive in snap-action, interlocking relationships the corresponding hexagonal male end of the connection end 8 for detachably connecting the cutter bit 2 to the drill rod 6, as known in the art.

In the form shown, the shank portion 14 includes a pair of oppositely disposed dust collection openings 26 defined by inverted, generally C-shaped planar surfaces 28. In the invention, the openings 26 are preferably of a polygonal, such as square, configuration defined by vertical marginal side edges 25 and horizontal marginal end edges 27. However, the openings could be of other shapes such as rectangular or the like. The openings 26 are disposed in vertical planes that extend parallel (FIGS. 2 and 3) to one another and parallel to the longitudinal central axis, designated at Y, of the cutter bit 2. Accordingly, the marginal end edges 27 are disposed at right angles to the axis Y with the openings 26 being diametrically centered in respect to such axis.

In the form shown, the openings 26 are off-set, radially inwardly from the outer peripheral surface of the shank portion 14 by a predetermined distance so as to provide a pair of oppositely disposed, generally parallel extending, transverse, shoulder portions 30. The shoulder portions 30 are disposed at the juncture of the lower marginal end edges 27 of the respective openings 26 and with the shoulder portions 30 being preferably disposed at generally the mid-point in respect to the axial length of the shank portion 14. By this arrangement, the openings are provided with a maximum cross-sectional areas and are disposed substantially in the upper-half of the shank portion 14. By this arrangement, the transverse dimension across the openings 26 is determined by the thickness of the material of the shank portion 14.

The shank portion 14 includes a pair of oppositely disposed, upstanding web portions 32 which are made integral with and support the head portion 34. As shown, the web portions 32 are generally arcuate, in transverse section, and are disposed in vertical planes which extend at right angles to the general planes containing the associated openings 26. Except for the openings 26, the web portions 32 connect the shank portion 14 to the head portion 34 to provide the unitary, one-piece construction shown.

In the invention, the head portion 34 is of a solid construction and has a multiple work surface configuration defined by a first pair of oppositely disposed tapered heel surfaces 36 and a second pair of oppositely disposed tapered compression surfaces 38. The tapered heel surfaces 36 (FIG. 6 and 7) are slightly conical, in side elevation, and extend downwardly and outwardly in a direction away from the longitudinal central axis Y and provide a backup or support for the carbide cutter element C. Preferably, the tapered heel surfaces 36 extend downwardly and outwardly at an angle (h) of approximately 20 (horizontal) degrees. The other pair of tapered compression surfaces 38 are of a substantially planar configuration, in side elevation, and extend downwardly and outwardly away from the axis Y. The tapered compression surfaces 38 are preferably disposed at a greater angle of inclination than that of the tapered heel surfaces 36. Preferably, the compression surfaces define a compression angle (c) of approximately 60 (vertical) degrees. In the invention, it is preferred that the angle of inclination of the compression surfaces 38 be between about 45° and 80° with the preferred angle being 60°.

In the embodiment shown, the tapered compression surfaces 38 extend downwardly and outwardly in a direction toward the openings 26 and provide horizontal shear edges 39 (FIGS. 2, 6 and 7) to cause an abrading and shearing action on the drill cuttings. Also, this causes such cuttings to be progressively reduced to a relatively fine dust-like consistency for delivery to and through the dust collecting openings 26 for discharge and removal through the bore 16, as will be more fully described hereinafter.

Figure 6:
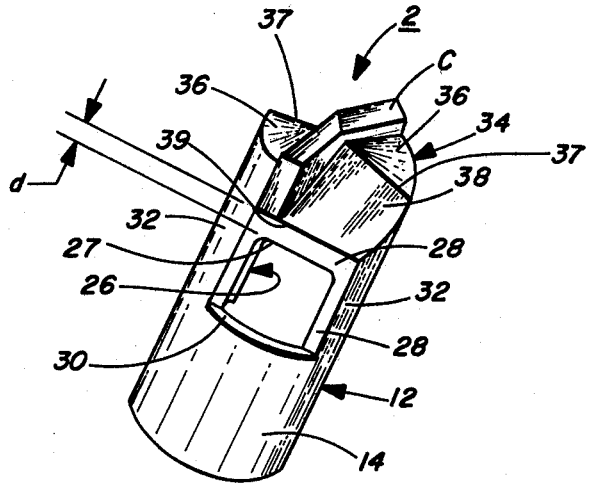
FIG. 6 is a generally perspective view of the cutter bit of the invention.

The dust collecting openings 26, in the embodiment illustrated, are disposed below the tapered compression surfaces 38 with such surfaces 38 having a width-wise dimension substantially equal to the corresponding transverse dimension of the respective openings 26. Accordingly, the shear edges 39 of the openings compression surfaces 38 extend generally parallel (FIG. 6)

to the corresponding upper marginal edges 27 of the openings 26. In the embodiment shown, the openings 26 are vertically spaced from the head portion 34 by a predetermined distance, designated generally at (d), which distance define the marginal ride surfaces 28. By this arrangement, the reduced dust-laden material is automatically metered off the tapered compression surfaces 38 and the shear edges 39 and into the dust collection openings 26. This is accomplished in a manner so as not to crowd the openings 26 thereby preventing bridging or clogging of the openings and hence, the dust passage through the drill rod.

In the invention, the dust collection openings 26 are quickly and easily formed by a suitable machining operation, such as by milling or the like. This metal working removes the outer peripheral material of the shank portion 14 so as to form the marginal inverted, generally C-shaped side surfaces 28 in conjunction with the transversely extending shoulder portions 30. By this arrangement, the shoulder portions 30 act to provide an abutment or a stop-like means to direct the dust-laden material to be drawn off the tapered compression surfaces 38 into and down through the openings 26. Hence, the openings 26 are automatically formed to the predetermined polygonal shape by removal of the excess material of the shank portion 14.

Figure 5:
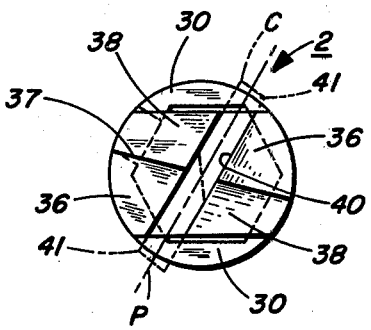
FIG. 5 is a top plan view looking in the direction of the line 5—5 of FIG. 2.

As best illustrated in FIG. 5, the tapered heel surfaces 36 are disposed on opposite sides of a vertical plane P that passes through the longitudinal central axis Y of the cutter bit 2. Similarly, the other tapered compression surfaces 38 are also disposed on opposite sides of the vertical plane P such that one of the surfaces 36 and 38 of each pair are disposed on the same side of the plane P so as to merge into apex edges 37 on opposed sides of the carbide C. These apex edges 37 lie in substantially the same general plane with one another and extend at an angle relative to the general vertical planes containing the dust collection openings 26.

Figure 7:
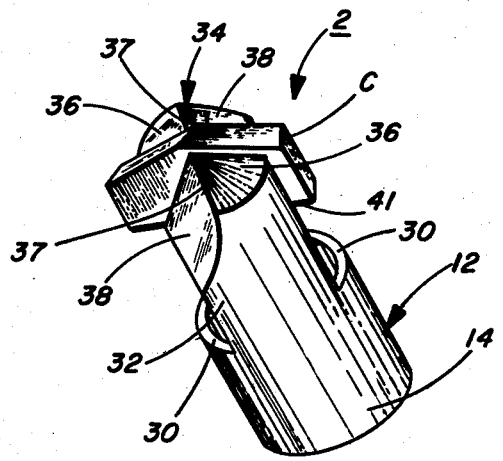
FIG. 7 is a generally perspective view of the cutter bit of FIG. 6 but rotated approximately 90 degrees.

In the invention, the multiple heel and compression surfaces 36 and 38 together define a transversely extending groove or slot 40 (FIGS. 4 and 5) adapted to receive a cutter insert, designated generally in phantom lines at C. In FIGS. 6 and 7, the cutter C has been illustrated in solid line to designate the installed condition thereof. Conventionally, the cutter insert C is preferably made of a high strength, wear-resistant material formed of tungsten carbide or the like and in a plate-like configuration. In such case, the cutter insert C may be permanently or detachably secured within the slot 40, as known in the art.

It will be seen that the dust collecting openings 26 are defined, in part, by the inwardly off-set side surfaces 28 and the shoulder portions 30 so as to lie in planes which are generally disposed parallel to the longitudinal central axis Y of the cutter bit 2. Accordingly, the openings 26 are disposed diametrically opposite to one another and define with the surfaces 28 and shoulder portions 30 dust collection intake passageways 35 (FIGS. 3 and 8) to progressively meter reduced dust material into the openings 26 which extend parallel to one another and on opposed sides of the longitudinal central axis Y of the drill bit.

The groove or slot 40 (FIG. 4) for receiving the cutter insert C is preferably disposed at an angle (a) of between about 35 degrees and 40 degrees relative to the general vertical plane containing the openings 26 dependent upon the size of the cutter bit. The cutter insert C extends outwardly at both ends of the slot 40 a predetermined length, as at 41, and over the intake passageways 35 to provide a clearance for drilling the hole 10. The inner exposed side surfaces of the insert C are disposed in generally vertical alignment with the respective side edges 27 defining the respective openings 26, as best illustrated in FIG. 6. By this arrangement, drilled cuttings are directed downwardly and outwardly over the compression surfaces 38 for maximum discharge without obstruction by the confronting exposed surfaces of the cutter insert C. In addition, by this arrangement the symmetrically disposed surfaces 36 and 38 in conjunction with the integral web portions 32 provide a substantial mass of solid material to maximize the strength characteristics of the head portion 34 for stabilizing and supporting the cutter insert C during normal usage. Accordingly, by this arrangement there is provided a shank and integral head portions which together have a generally polygonal, such as rectangular, configuration in top plane view (FIG. 5) for greatly enhancing the strength and wear characteristics of the cutter bit. Though the shank portion 14 of the drill bit 2 has been described and illustrated as of a hollow cylindrical construction, it is recognized that such shank portion may be formed in other configurations as, for example, that of non-circular such as of an ellipse or hexagonal in transverse section, as desired.

In a typical operation for utilizing the invention, the cutter bit 2, as seen in FIG. 8, is secured to the drill rod 6 via the connection end 8 such that the bore 16 in the cutter bit 2 is disposed in communication with the hollow drill rod 6. The drill rod 6 may then be connected to a suitable vacuum pump (not shown) to apply a suction in the bore 16 for removal of drill cuttings. The suction in the bore 16 is transmitted to the dust collection openings 26 which act to draw the cuttings down across the compression surfaces 38 and over the shear edges 39 which act, by abrasive and shear forces, to progressively reduce the relative particle size of the cuttings to a relatively fine dust. As this reduced dust material is transmitted downwardly and outwardly over the shear edges 39, it is provided with a metering action as it descends vertically downwardly through the intake passageways 35 and into the openings 26. As will be seen the dust particles, designated at D, are progressively reduced in size as they move across the surfaces 38 and over the shear edges 39 due to the downward and inward compression forces exerted by the strata surrounding and defining the drill hole 10. This action, in effect, compresses the dust material against the surfaces 38 and with the area immediately under the shear edges 39 providing an inlet orifice to the intake passageways 35 which meter the reduced material for free flow into the openings 26 for discharge through the bore 16, as shon by the arrows. By this compression and metering action, substantially no bridging or clogging of the openings 26 takes place during the drilling operation especially in relatively soft-rock formations. Accordingly, this inter-action between the component parts improves the flow of drilling waste and expedites the drilling operation. Further, this inter-action provides an unobstructed passage through the bore 16 via the openings 26 to the vacuum source so as to further enhance the flow of drill cuttings and speeding the drilling operation. In addition, it will be seen that this inter-action generates air-flow within the bore 16 and holes 26 to provide a cleaning action as well as a cooling air-flow around the drill bit. In the alternative, a coolant fluid may be flowed into the bore 16 and openings 26 to cool the drill bit while simultaneously washing away the drill cuttings and dust.

I claim:

1. A cutter bit for drills having good drilling performance characteristics in relatively soft rock formations as well as in medium and hard rock formations comprising:

a body defined by an elongated shank portion having a bore extending from an open end thereof and a head portion made integral with and extending outwardly from said shank portion said head portion including a transversely extending slot opening therefrom and adapted to receive a plate-like insert cutter element therein, said head portion having multiple work surfaces including a first pair of oppositely disposed tapered heel surfaces extending downwardly and outwardly in a direction away from the longitudinal central axis of said bore, a second pair of oppositely disposed tapered compression surfaces extending downwardly and outwardly in a direction away from said longitudinal central axis, said second pair of tapered compression surfaces being disposed at an inclined angle greater than that of said first pair of tapered heel surfaces to progressively reduce drill cuttings to a relatively dust-like consistency, the respective surfaces of said first pair of tapered heel surfaces being located on opposite sides of said slot, and the respective surfaces of said second pair of tapered compression surfaces being located on opposite sides of said slot, said shank portion having an oppositely disposed pair of dust collection openings disposed below said head portion and in communication with said bore for removing said dust-like material formed during drilling, said second pair of tapered compression surfaces extending downwardly toward the respective of said dust collection openings, and said first pair of tapered heel surfaces being generally conical in side elevation and said second pair of tapered compression surfaces being generally planar in side elevation.

2. A cutter bit in accordance with claim 1 wherein the lowermost terminal edges of said planar tapered compression surfaces are spaced vertically upwardly from said dust collection openings.

3. A cutter but in accordance with claim 1 wherein said shank portion is of a hollow, cylindrical construction including socket means adapted for detachable securement to a drill rod.

4. A cutter bit in accordance with claim 1 wherein the angle of inclination of said first pair of tapered heel surfaces in relation to the angle of inclination of said second pair of tapered compression surfaces is in the ratio of approximately 1:3.

5. A cutter bit in accordance with claim 1, wherein said dust collection openings are off-set, radially inwardly from the outer peripheral surfaces of said shank portion and are disposed in planes which extend generally parallel to one another to define vertical dust collection intake passageways, said slot extending at an acute angle relative to the planes containing said dust collection openings and passageways, said shank portion including shoulder portions extending transversely adjacent the bottom of said dust collection openings, and said openings in side elevation being of a polygonal configuration.

6. A cutter bit in accordance with claim 1, wherein said slot extends diametrically through the longitudinal central axis of said bore and is disposed at an acute angle in respect to the respective general planes defined by said dust collection openings.

7. A cutter bit in accordance with claim 6, wherein said dust collection openings are of a polygonal configuration disposed in planes which extend parallel to one another, said second pair of tapered compression surfaces extending downwardly and outwardly in the direction toward said dust collection openings, said shank portion being of a hollow, cylindrical construction, said dust collection openings being off-set radially, inwardly from the outer peripheral surface of said shank portion, and said second pair of tapered compression surfaces having a width-wise dimension substantially equal to the corresponding width-wise dimension of said dust collection openings.

8. A cutter bit in accordance with claim 1, wherein said shank portion is of a hollow, elongated cylindrical construction defining said bore, said shank portion having upwardly extending web portions made integral with and supporting said head portion, said head portion being of a solid construction and being formed with said transversely extending slot, said dust collection openings being of a polygonal configuration disposed between said web portions, and the upper marginal edges of said dust collection openings being disposed adjacent the juncture of said web portions with said head portion.

9. A cutter bit in accordance with claim 8 wherein said dust collection openings are disposed in general planes which extend parallel to one another, and the planes containing said dust collection openings being disposed at right angles to the general vertical planes containing said web portions.

10. A cutter bit in accordance with claim 9 wherein a cutter element is disposed in said slot so as to extend angularly outwardly at an acute angle in respect to the general planes containing said openings and so as not to substantially overlie said dust collection openings.

11. A cutter bit in accordance with claim 10 wherein said cutter element has a lengthwise dimension greater than the corresponding transverse dimension of said head portion so as to extend at either end outwardly beyond the corresponding maximum dimension of said head portion so as to provide terminal end edges which project outwardly beyond said dust collection openings, and the exposed sides of said terminal end edges being disposed in generally vertical alignment with the corresponding vertical marginal side edges defining said dust collection openings.

12. A cutter bit for drills having good drilling performance characteristics in relatively soft rock formations as well as in medium and hard rock formations comprising:

a unitary, one-piece body defined by an elongated, hollow shank portion having a bore extending from an open end thereof, said body including an integral solid head portion extending outwardly from said shank portion at the end opposite said open end thereof, said head portion having multiple work surfaces including a first pair of oppositely disposed tapered heel surfaces extending downwardly and outwardly in a direction away from the longitudinal central axis of said bore, a second pair of oppositely disposed tapered compression surfaces extending downwardly and outwardly in a direction away from said longitudinal central axis, said second pair of tapered compression surfaces being disposed at an inclined angle greater than that of said first pair of tapered heel surfaces adapted to progressively reduce drill cuttings to a substantially reduced particle size, said head portion including a transversely extending slot opening upwardly therefrom to receive a plate-like insert cutter element therein, the tapered heel surfaces of said first pair of surfaces being disposed on opposite sides of said cutter element with the other tapered compression surfaces of said second pair of surfaces being disposed on opposite sides of said cutter element with said slot extending diametrically through the longitudinal central axis of said bore, said shank portion having an oppositely disposed pair of dust collection openings disposed below the tapered compression surfaces of said head portion and disposed in communication with said with said bore adapted for removing the reduced particle size material formed during drilling said dust collection openings being off-set radially, inwardly from the outer peripheral surface of said shank portion and being disposed in planes which extend generally parallel to one another to define generally verticle dust collection intake passageways, said dust collection openings being of a generally polygonal configuration in side elevation with said second pair of tapered compression surfaces extending downwardly and outwardly at an angle in a direction toward the associated of said dust collection openings, said shank portion including shoulder portions extending transversely adjacent the bottom of associated of said dust collection openings, and the juncture of said second pair of tapered compression surfaces with the general planes containing said dust collection openings defining transversely extending shear edges which extend generally parallel to said shoulder portions adapted for metering the reduced particle size material moved off said tapered compression surfaces into said dust collection openings by means of said intake passageways.

13. A cutter bit device in accordance with claim 12, wherein, said transversely extending shear edges are spaced vertically upwardly from said dust collection openings with said shear edges disposed in generally the same horizontal plane with one another.

14. A cutter bit in accordance with claim 12, wherein, said shank portion has integral upwardly extending web portions having an arcuate configuration in horizontal cross-section which act to support said head portion with said dust collection openings being disposed between said web portions.

15. A cutter bit in accordance with claim 12, wherein, said shank portion includes an interior socket means adapted for detachable securement to a drill rod.

16. A cutter bit in accordance with claim 12, wherein said pair of tapered compression surfaces is disposed at an angle between about 45° and 80° with the angle of inclination of said first pair of tapered heel surfaces being disposed at an angle less than the taper of said second pair of tapered compression surfaces.

17. A cutter bit in accordance with claim 12, wherein said dust collection openings are of a polygonal configuration, in side elevation, with material of said shank portion being formed to provide transversely extending shoulder portions defining the bottom of each of said dust collection openings, and said shoulder portions acting as abuttment means to direct said reduced particle size material into and down through said dust collection openings.

18. A cutter bit in accordance with claim 12, wherein said dust collection openings are of a polygonal configuration, in side elevation, said dust collection openings being disposed in vertical planes which extend substantially parallel to one another and perpendicular to said shoulder portions, said second pair of tapered compression surfaces extending downwardly and outwardly in a direction toward said dust collection openings with the width-wise dimension of said second pair of compression surfaces being substantially equal to the corresponding transverse dimension of said dust collection openings, and the lower most terminal end edges of said second pair of tapered compression surfaces being spaced vertically upwardly from said dust collection openings so as to define with said shoulder portions vertically extending intake passageways which communicate with said bore with said intake passageways acting to meter reduced particle size material delivered from said second pair of compression surfaces through said dust collection openings into said bore for removal from said bore.

19. A cutter bit for drills having good drilling performance characteristics for various drilling operations, such as in coal roof mining or the like comprising:

a unitary, one-piece body defined by an elongated, hollow shank portion of cylindrical configuration having a bore extending from an open end thereof, said body including an integral, solid head portion extending outwardly from said shank portion at the end opposite said open end thereof, said shank portion having integral upwardly extending web portions having an arcuate configuration in transverse cross-section with said web portions being oppositely disposed and extending in a lengthwise direction parallel to the longitudinal central axis of said bore, said head portion having multiple work surfaces including a first pair of oppositely disposed tapered heel surfaces extending downwardly and outwardly in a direction away from the longitudinal central axis of said bore, a second pair of oppositely disposed tapered compression surfaces extending downwardly and outwardly in a direction away from said longitudinal central axis, said second pair of tapered compression surfaces providing ledge-like structures and being disposed at an inclined angle greater than that of said first pair of tapered heel surfaces adapted to progressively reduce by an abrading and shearing action drill cuttings to a reduced particle size, said head portion including a transversely extending slot opening upward therefrom and having a plate-like carbide insert cutter element fixedly disposed therein, the tapered heel surfaces of said first pair of surfaces being disposed on opposite sides of said cutter element with the other tapered compression surfaces of said second pair of surfaces being disposed on opposite sides of said cutter element and with said slot extending transversely through the longitudinal central axis of said bore, said shank portion having an oppositely disposed pair of dust collection openings disposed between said web portions and below the tapered compression surfaces of said head portion and communicating with said bore and adapted for removing the reduced particle size material formed during drilling, said shank portion including shoulder portions extending transversely adjacent the bottom of associated of said dust collection openings, the juncture of said second pair of tapered compression surfaces with the general planes containing said dust collection openings defining transversely extending shear edges which extend generally parallel to said shoulder portions and are adapted for metering the reduced particle size materials moved off said tapered compression surfaces into said dust collection openings, said dust collection openings being generally defined by the open space between said head portion, web portions and shoulder portions and being disposed in substantially flat planes which extend parallel to one another and perpendicular to said shoulder portions, said second pair of tapered compression surfaces extending downwardly and outwardly in a general direction toward the associated of said dust collection openings, and the lower most terminal end edges of second pair of tapered compression surfaces being spaced axially upwardly from said dust collection openings so as to define with said shoulder portions longitudinally extending intake passageways disposed on opposite sides of said web portions adapted to meter reduced particle size material delivered from said second pair of compression surfaces through said dust collection openings and into said bore for removal from said bore.

20. A cutter bit in accordance with claim 19, wherein:

said dust collection openings are of a general polygonal configuration, in side elevation, with the material of said shank portion being formed by machining to provide said shoulder portions, and said shoulder portions acting as abuttment means adapted to direct said reduced particle size material into and down through said dust collection openings.

21. A cutter bit in accordance with claim 20, wherein:

said bit is made from metal and said dust collection openings are of a generally polygonal shaped configuration, in side elevation, defined by material removed from the outer peripheral surface of said shank portion which simultaneously defines said shoulder portions and said shear edges.

22. A cutter bit in accordance with claim 19, wherein:

the angle of inclination of said second pair of tapered compression surfaces is approximately 60°.

23. A cutter bit in accordance with claim 19, wherein:

said shoulder portions are disposed at the juncture between the lower marginal end edges of the respective dust collection openings and with said shoulder portions being disposed at substantially the mid-point in relation to the axial length of said shank portion whereby the maximum cross-sectional areas of said dust collection openings are disposed substantially in the upper-half of said shank portion.

* * * * *

UNITED STATES PATENT AND TRADEMARK OFFICE

CERTIFICATE OF CORRECTION

PATENT NO. : 4,313,506

DATED : February 2, 1982

INVENTOR(S) : Thomas L. O'Connell

It is certified that error appears in the above—identified patent and that said Letters Patent is hereby corrected as shown below:

Column 5, line 5, "ride" should be -- side --.

Column 6, line 54, "shon" should be -- shown --.

Column 9, line 31, delete "with said", first occurrence.

Column 10, line 17 (Claim 17), "abuttment" should be -- abutment --.

Column 12, line 16 (Claim 20), "abuttment" should be abutment --.

Signed and Sealed this

*Eighteenth* Day of *May 1982*

[SEAL]

*Attest:*

GERALD J. MOSSINGHOFF

*Attesting Officer*

*Commissioner of Patents and Trademarks*